US007444797B2

(12) United States Patent
Tosa

(10) Patent No.: US 7,444,797 B2
(45) Date of Patent: Nov. 4, 2008

(54) DEVICE FOR ELIMINATING THE TRAILING END THAT IS FORMED IN THE FILM COMING OFF WRAPPING MACHINES FOR WRAPPING PALLETIZED LOADS WHEN THE REEL OF FILM IS REPLACED

(75) Inventor: Giuseppe Tosa, Cossano Belbo (IT)

(73) Assignee: Tosa S.r.l., Cosano Belbo (CN) (IT)

( * ) Notice: Subject to any disclaimer, the term of this patent is extended or adjusted under 35 U.S.C. 154(b) by 75 days.

(21) Appl. No.: 11/271,110

(22) Filed: Nov. 10, 2005

(65) Prior Publication Data

US 2006/0130437 A1 Jun. 22, 2006

(30) Foreign Application Priority Data

Nov. 12, 2004 (IT) ..... TO2004A0793

(51) Int. Cl.
*G65G 57/02* (2006.01)
*B65B 53/00* (2006.01)

(52) U.S. Cl. ..... 53/505; 53/556

(58) Field of Classification Search ..... 53/556, 53/220, 52, 505
See application file for complete search history.

(56) References Cited

U.S. PATENT DOCUMENTS 5,203,935 A * 4/1993 May et al. ..... 156/64
5,215,276 A 6/1993 Aoki et al.
5,365,723 A * 11/1994 Ramos ..... 53/556
5,474,252 A 12/1995 Schmid
5,509,253 A * 4/1996 Cappi et al. ..... 53/441
5,816,026 A * 10/1998 Orpen ..... 53/441
5,833,168 A 11/1998 Tahata et al.

FOREIGN PATENT DOCUMENTS

EP 1 462 402 A1 9/2004

* cited by examiner

*Primary Examiner*—Rinaldi I Rada
*Assistant Examiner*—John Paradiso
(74) *Attorney, Agent, or Firm*—Merchant & Gould P.C.

(57) ABSTRACT

A device for eliminating the trailing end of the film that is formed on wrapping machines for wrapping palletized loads when the reel of film is replaced, is of the type in which the wrapping machine is equipped with: a first, reel-holder, assembly, constituted by pre-stretching rollers driven by motor means, return idlers and a compensator arm; and a second, welding, assembly constituted by a gripper, welding means, and cutting means; the film sliding between the reel, said first assembly and said second assembly, and the load set on the pallet. Positioned between the reel and the first assembly is a mobile unit provided with a re-winding roller designed to press on the reel in operating conditions.

4 Claims, 2 Drawing Sheets

DEVICE FOR ELIMINATING THE TRAILING END THAT IS FORMED IN THE FILM COMING OFF WRAPPING MACHINES FOR WRAPPING PALLETIZED LOADS WHEN THE REEL OF FILM IS REPLACED

A device for eliminating the trailing end that is formed in the film coming off wrapping machines for wrapping palletized loads when the reel of film is replaced.

DESCRIPTION

The subject of the invention is a device for eliminating the trailing end that is formed in the film coming off wrapping machines for wrapping palletized loads when the reel of film is replaced.

In an automatic wrapping machine, during the operation of wrapping of palletized loads, sooner or later the reel of film inevitably runs out, whilst in some cases it is the reel itself that presents defects; in either situation, of course, the reel must be replaced.

Replacement of the reel can occur automatically as described and illustrated, for example, in the patent application Ser. No. TO2004A000129 filed on Mar. 2, 2004 in the name of the present applicant.

Normally, when the film runs out, or when the film tears or is defective, the end part or trailing end of the wrapping film, which very often is not completely wrapped round the pallet, remains dangling down loose along a face of the pallet at any height, since the position that it can occupy is obviously altogether random.

The above drawback causes inefficiencies in stacking of the pallets in automatic warehouses, since at times the trailing end left flapping, which alters the shape of the pallet, is detected and, consequently, the pallet is rejected. At this point a fault is signalled, which stops the automatic cycle. Consequently, the protruding trailing end of the film needs to be removed immediately.

The purpose of the present invention is to overcome the aforesaid drawbacks. To achieve this purpose, the invention proposes a device according to claim 1 for eliminating the trailing end of the film that is formed on wrapping machines for wrapping palletized loads when the reel of film is replaced.

The device according to the invention will now be described with reference to the attached plate of drawings, in which.

Figure 1:
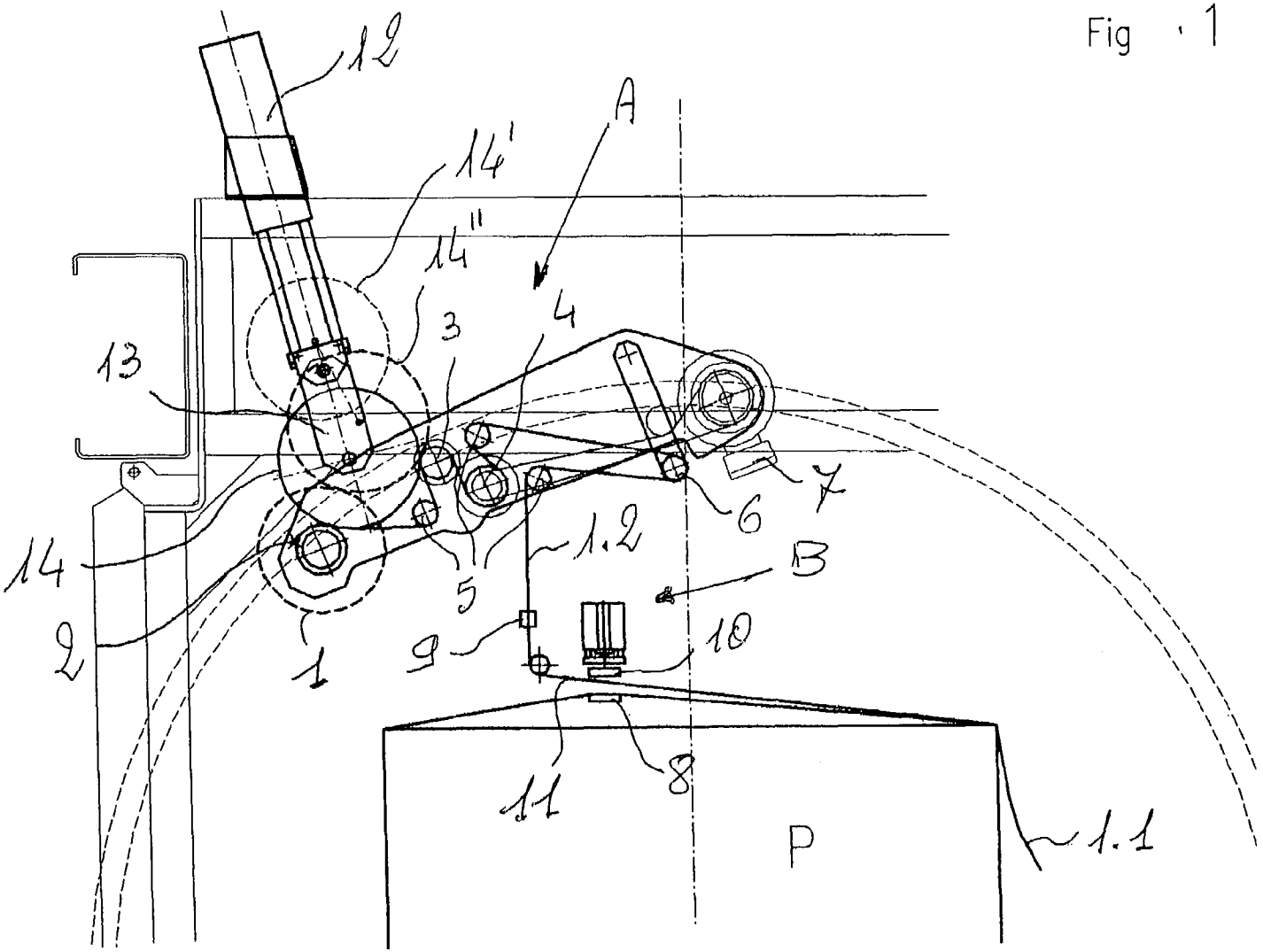
FIG. 1 is a front view of the device according to the invention.
Figure 2:
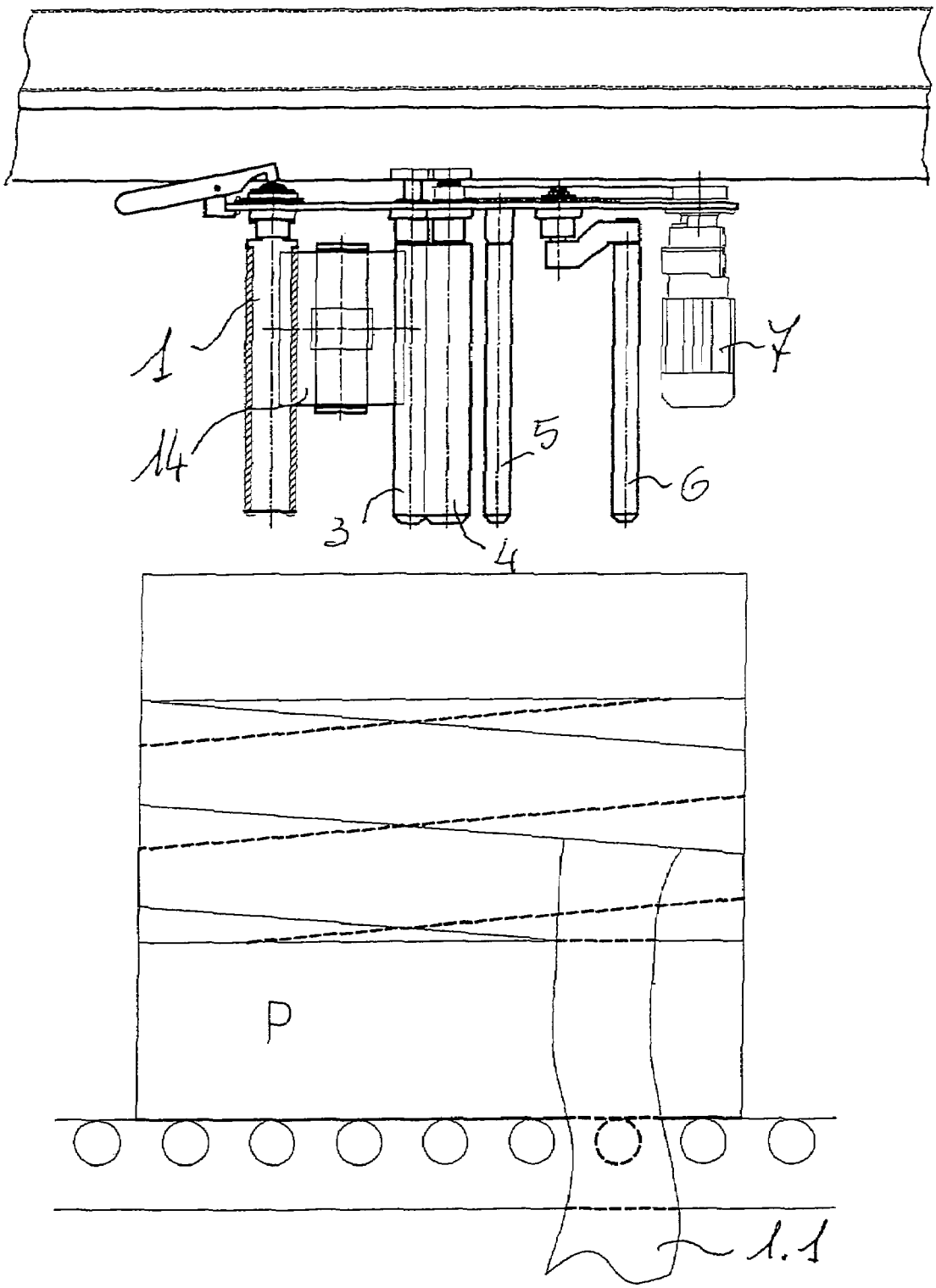
FIG. 2 is a plan view of the device of Figure

In order to enable automatic elimination of the trailing end 1:1 of the film that is wrapped around a product P loaded on a pallet, in the first place the diameter of the reel 1 that is about to run out must be detected by means of a purposely provided sensor 2.

In this way, it is possible to complete the cycle, even though the wrapping operation has not yet been completed, and formation of the trailing end 1:1 is prevented, since said trailing end is welded onto the underlying layer of wrapping.

When, instead, the reel needs to be replaced because it is defective or for any other reason, a pushbutton (not illustrated) which has the same function as the sensor 2 is operated manually.

In order to complete the wrapping cycle, in a known way, the counterbar 8 is lowered and is wound with a few turns of film, after which rotation of the wrapping machine is stopped and a welding assembly B, constituted by a gripper 9, a welder 10, and cutting means 11, is lowered.

Next, the gripper 9 is closed and the welder 10 and the cutting means 11 are made to advance. After cutting of the film has been carried out using the purposely provided means 11, the welder 10 and the cutting means 11 move back, the counterbar 8 is slid away, and the assembly formed by the gripper 9, the welder 10, and the cutting means 11 is raised. Finally, the gripper 9 is opened so as to release the cut-away end of the film coming off the reel.

To carry out replacement of the reel 1, the stretch of film 1.2 inserted in the reel-holder assembly A must be rewound around the pre-stretching rollers 3 and 4, the return idlers 5 and the compensator arm 6. Of the pre-stretching rollers, the slow one is designated by 3 and the fast one by 4. Both of the rollers 3 and 4 are driven by the motor 7.

The reel-holder assembly A is displaced, should it be necessary, into the rewinding position, where, according to the invention, a pneumatic guide unit 12 or any other equivalent system is located, at the oscillating end 13 of which there being fixed the rewinding roller (or wheel) 14, which may be either idle or motor-driven.

The position of the roller 14 during normal winding of the film on the pallet is the resting, i.e., raised, one, indicated with a thin dashed line and designated by 14'.

The roller (or wheel) 14, in operating conditions, is pushed by the guide 12 against the reel 1 and against the slow pre-stretching roller 3. If reel change has to take place following upon a failure when the reel 1 is still partially full, the roller 14 will position itself as indicated by the thick dashed line designated by 14". If, instead, the reel 1 has almost run out, the roller 14 will position itself as indicated by the solid line designated by 14.

In the case where the roller 14 is idle (solution illustrated in FIG. 1), it will position itself with an adjustable pressure adequate for transmitting rotation to the reel 1 by means of the slow motor-driven pre-stretching roller 3, the driving motor 7 of which has reversed its motion. The part of film 1.2 that is still in the reel-holder assembly A is thus wound back on the reel 1 that has run out or is defective.

When the simultaneous contact of the roller (or wheel) 14 on the reel 1 that has run out and on the slow pre-stretching roller 3 is not possible (for example, in other types of pre-stretching rollers not illustrated), there is the contact of the roller (or wheel) 14 (in this case a motor-driven one) only on the reel 1 that has run out, whilst the motor 7 for controlling pre-stretching has reversed its motion. Also in this latter case, the part of film 1.2 that is still within the reel-holder assembly A is wound back on the reel 1 that has run out or is detective.

When rewinding is completed, the pre-stretching motor 7 stops, the roller (or wheel) 14 (if motor-driven, it also stops) moves back into the resting position 14', and the wrapping machine starts the cycle for automatic reel change, as, for example, is described in the aforesaid patent application Ser. No. TO2004A000129, filed on Mar. 2, 2004 in the name of the present applicant.

The reel can be rewound even if it has just been replaced, thanks to the oscillating end 13 on which the roller (or wheel) 14 is fixed, which enables said roller (or wheel) 14 to come into contact with the slow pre-stretching roller 3 and the reel 1, even if the reel 1 has a diameter that is larger (as indicated with the dashed line 14" of FIG. 1) than the diameter of the reel that has run out (as indicated with the solid line 14 in FIG. 1).

When the reel has been replaced, the automatic wrapping machine resumes the wrapping cycle from the start.

The invention claimed is:

1. A device for eliminating the trailing end of film that is formed on wrapping machines for wrapping palletized loads when a reel of film is replaced, said device comprising:

a first reel holder assembly having pre-stretching rollers driven by a reversible motor, return idlers and a compensator arm;

a second welding assembly having a gripper, a welder and a cutter, wherein the second assembly is movable between a first position for engaging the film and a second retracted position;

the film sliding between the reel, said first assembly, said second assembly, and the load set on the pallet;

a mobile unit positioned between the reel and the first assembly, the mobile unit having a re-winding roller at an extended end of the mobile unit and a guide configured to position the re-winding roller in engagement with the reel in operating conditions for driving rewinding of the reel; and an actuator governed by a sensor for detecting running-out of the reel, wherein the film is wound around the sensor;

wherein the cutter is configured to cut the trailing end of the film on the palletized load that has been wrapped, and the welder is configured to weld the trailing end of the film with completion of the wrapping cycle and release of the cut-away end of the wrapping film by opening of said gripper;

wherein at the engaged position, the mobile unit extends and moves the re-winding roller into engagement with the reel;

wherein the reversible motor determines the direction of film travel along the path between the reel and the second assembly; and wherein the re-winding roller is rotatable in the direction that determines re-winding of the reel engaging the roller when the mobile unit is extended and the re-winding roller engages the reel.

2. The device according to claim 1, wherein the mobile unit comprises a pneumatic guide having an oscillating end, wherein the rewinding roller is fixed to the oscillating end.

3. The device according to claim 2, wherein when the re-winding roller is idle and pushed against one of the motor-driven pre-stretching rollers, the motor drives the engaged pre-stretching roller to draw the film, so that the pre-stretching roller draws in rotation the re-winding roller and the reel.

4. The device according to claim 2, wherein the re-winding roller is motor-driven and only engages the reel in operating conditions.

* * * * *